United States Patent [19]

Yaginuma et al.

[11] 4,151,669

[45] May 1, 1979

[54] LEAF TYPE INDICATING DEVICE

[75] Inventors: Jusuke Yaginuma, Koriyama; Mitsuji Sekine, Tokorozawa, both of Japan

[73] Assignee: Copal Company Limited, Tokyo, Japan

[21] Appl. No.: 844,391

[22] Filed: Oct. 21, 1977

[30] Foreign Application Priority Data

Oct. 30, 1976 [JP] Japan ..... 51-146163[U]

[51] Int. Cl.[2] ..... G09F 11/02

[52] U.S. Cl. ..... 40/500; 58/125 C

[58] Field of Search ..... 40/500; 58/125 C, 126 E

[56] References Cited

U.S. PATENT DOCUMENTS

| | | | |
|---|---|---|---|
| 733,180 | 7/1903 | Fitch | 58/126 E |
| 1,090,172 | 3/1914 | Shanks | 58/126 E |
| 3,973,339 | 8/1976 | Ueda | 58/125 C |
| 4,012,898 | 3/1977 | Yoshizawa | 58/126 E |

*Primary Examiner*—Russell R. Kinsey
*Assistant Examiner*—Paul J. Hirsch
*Attorney, Agent, or Firm*—Cushman, Darby & Cushman

[57] ABSTRACT

A leaf type indicating device provided with a synchronizing piece made of a spring material, rotatably mounted on a main shaft and having a side portion engageable with a lug formed on one leaf belonging to a first indicating leaf group having a large number of turns per unit time, a bent portion engageable with at least one leaf belonging to a second indicating leaf group arranged adjacently to the first indicating leaf group and having a small number of turns per unit time and an end portion inserted in a hole formed in a body frame and connected with the body frame in order to make the manufacture at a low cost possible.

5 Claims, 7 Drawing Figures

LEAF TYPE INDICATING DEVICE

BACKGROUND OF THE INVENTION (a) Field of the Invention

This invention relates to a structure of a synchronizing piece to synchronize the turning operations of a plurality of indicating leaves appearing in an indicating window in a leaf type indicating device and a method of fitting the same.

(b) Description of the Prior Art

In some leaf type indicating device, different contents can be successively shown in an indicating window by turning successively a plurality of indicating leaves arranged in a lateral direction. However, depending on the use of the indicating device, it is necessary to make the device so that a pair of leaves adjacent to each other may turn simultaneously at constant time intervals. A leaf type digital clock is a typical example requiring such function. That is to say, in the leaf type digital clock, it is necessary that the hour indication should be advanced by one step by turning the leaf indicating the hour digit simultaneously with the change from "59" to "00" by the turning of the leaf indicating the minute digit. In a conventional digital clock of this type, in order to attain such object, as shown in FIG. 1, a synchronizing piece 11' having a side portion 11'a with which a lug 4'$a_1$ of a minute indicating leaf 4'a can contact, a bent portion 11'b for temporarily locking an hour indicating leaf 6', a hole portion 11'c through which a main shaft 10' rotatably supporting a minute indicating drum 5' and an hour indicating drum 7' passes and an end portion 11'd inserted in a hole 1'a formed in a body frame 1' is provided between the minute indicating drum 5' pivotally supporting a minute indicating leaf group 4' including at least the one minute indicating leaf 4'a provided with the lug 4'$a_1$ on the side edge and rotating at a comparatively high speed and the hour indicating drum 7' pivotally supporting an hour indicating leaf group 6' and rotating at a comparatively low speed. The synchronizing piece 11' is so made as to be supported by inserting the main shaft 10' through the hole portion 11'c and to be held in a fixed position by inserting the end portion 11'd into the hole 1'a in the body frame 1'. However, in such arrangement of the synchronizing piece 11', the main shaft 10' must be passed through the hole portion 11'c of the synchronizing piece 11' and therefore, in assembling the device, the synchronizing piece 11' has had to be incorporated together with the two indicating drums 5' and 7'. Usually, there are further many working steps after this incorporating work and the synchronizing piece 11' is made of a very thin resilient material because the turning force of the minute indicating leaf 4'a is small.

Therefore, there has been a defect that the synchronizing piece 11' will be likely to be deformed in the assembling step. In order to dissolve these defects, there has been already suggested a method wherein the synchronizing piece 11' is fixed to the body frame 1'. However, with such method, there is a play in the axial direction of the minute and hour indicating drums 5' and 7' and therefore there has been a defect that their relative positions in the axial direction will slip and the synchronizing operation will become indefinite.

SUMMARY OF THE INVENTION

Therefore, a primary object of the present invention is to provide a synchronizing piece which is very simple to incorporate and is easy to replace.

Another object of the present invention is to provide a fitting structure of a synchronizing piece wherein an automatic assembly is possible and the synchronizing piece can be held accurately in a predetermined position.

These and other objects of the present invention will become more apparent during the course of the following detailed description and appeded claims.

DESCRIPTION OF THE PREFERRED EMBODIMENTS

Figure 1:
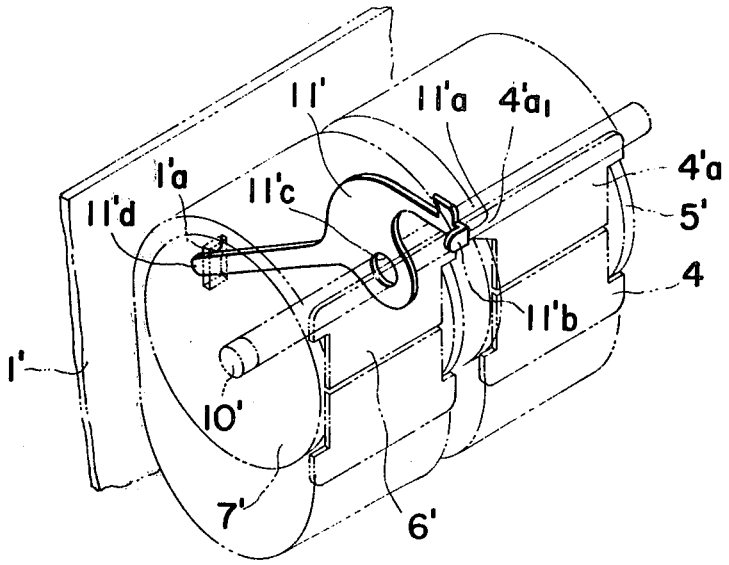
FIG. 1 PRIOR ART
FIG. 1 is a perspective view showing a shape and fitting structure of a synchronizing piece incorporated in a conventional leaf type indicating device.
Figure 2:
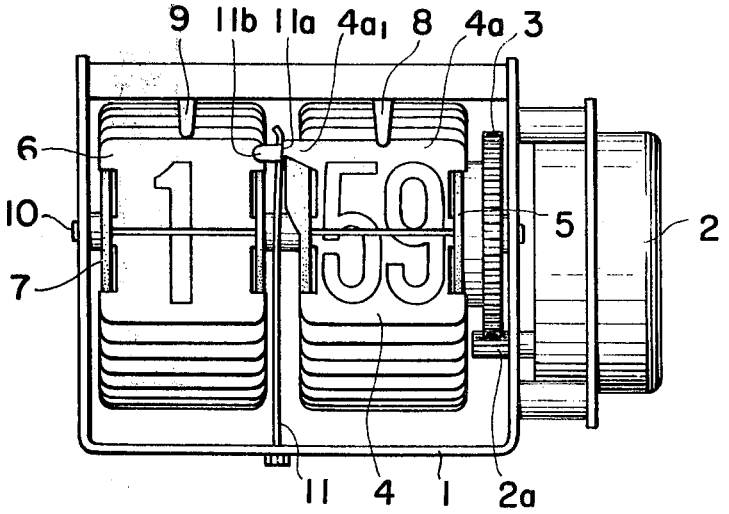
FIG. 2 is an elevation showing an embodiment of a leaf type indicating device according to the present invention.
Figure 3:
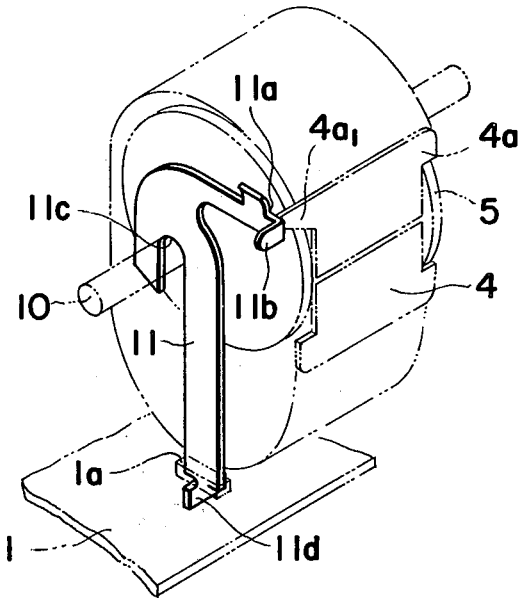
FIGS. 3, 4, 5 and 7 are perspective views showing embodiments different from each other in the shape and fitting structure of a synchronizing piece according to the present invention.

An embodiment in which the present invention is applied for a leaf type digital clock device shall be explained in detail with reference to FIGS. 2 to 4. In FIGS. 2 and 3, reference numeral 1 indicates a body frame provided with a through hole 1a in the bottom wall portion, 2 indicates a motor driving a clock mechanism and having a pinion 2a secured to its output shaft, 3 indicates a large gear meshing with the pinion 2a, 4 indicates a minute indicating leaf group including at least one leaf 4a provided with a lug 4$a_1$, 5 indicates a minute indicating drum pivotally supporting the minute indicating leaf group 4 and connected with the large gear 3 through a clutch mechanism not illustrated so that the rotation of the motor 2 may be transmitted as reduced to one revolution per hour, 6 indicates an hour indicating leaf group, 7 indicates an hour indicating drum pivotally supporting the hour indicating leaf group 6 and having the rotation of the minute indicating drum 5 transmitted to it as reduced to 1/24 by a gear mechanism not illustrated, 8 and 9 indicate pressing springs for temporarily retaining in upright positions respectively the minute indicating leaf 4 and hour indicating leaf 6 appearing in an indicating window not illustrated, 10 indicates a main shaft supporting the minute and hour indicating drums 5 and 7 and 11 indicates a synchronizing piece made of a resilient material and having a side portion 11a engageable with a lug 4$a_1$ of a minute indicating leaf 4a, a bent portion 11b for temporarily locking the turning operation of the hour indicating leaf 6, a cut portion 11c engaging with the main shaft 10 and an end portion 11d to be connected with the body frame 1 by being inserted in the through hole 1a and then twisted by about 90 degrees in the portion projected below the body frame. This synchronizing piece 11 is pushed in downward between the minute indicating drum 5 and hour indicating drum 6 while the cut portion 11c fits the main shaft 10 and the end portion 11*d* fits the through hole 1*a* and is then connected with the body frame 1 by twisting by about 90 degrees the end portion projected below the body frame 1. That is to say, the synchronizing piece 11 is fitted so as to be held by the main shaft 10 and body frame 1 through the cut portion 11*c* and end portion 11*d*.

The thus formed clock device operated as mentioned below. That is to say, the rotation of the motor 2 is transmitted to the minute indicating drum 5 through the pinion 2*a*, large gear 3 and clutch device not illustrated to rotate it clockwise in the position in FIG. 3 at a rate of one revolution per hour. By such rotation of the minute indicating drum 5, the minute indicating leaves 4 are unlocked one by one from the pressing spring 8 and are turned successively to indicate minutes. On the other hand, the rotation of the minute indicating drum 5 is transmitted to the hour indicating drum 7 through a reduction gear not illustrated to rotate it in the same direction as the minute indicating drum 4 at a rate of one revolution per 24 hours. By this rotation of the hour indicating drum 7, the hour indicating leaves 6 are unlocked one by one from the pressing spring 9 and are turned to indicate hours. In such case, when the minute indicating leaf 4 indicates 59 minutes, that is, when the minute indicating leaf 4*a* having the lug $4a_1$ comes to the indicating position, the lug $4a_1$ will push in the side portion 11*a* of the synchronizing piece 11 leftward in FIG. 3 and, as a result, the bent portion 11*b* will advance into the turning track of the hour indicating leaf 6 and, even if the hour indicating leaf 6 is unlocked from the pressing spring 9, it will not operate to turn. Thus, when the rotation of the minute indicating drum 5 advances and the minute indicating leaf 4*a* is unlocked from the pressing spring 8 and turns, the pressing of the side portion 11*a* of the synchronizing piece 11 by the lug $4a_1$ will be released, therefore the synchronizing piece 11 will return to the original position due to its own habit and the bent portion 11*b* will retreat out of the turning track of the hour indicating leaf 6. Therefore, only in case the minute indication changes from "59" to "00", the hour indicating leaf 6 and minute indicating leaf 4 will turn as synchronized with each other as a result.

By the way, the main component parts of the clock device shown in FIG. 2 are assembled as mentioned below. That is to say, first of all, the minute indicating drum 5 pivotally supporting the minute indicating leaves 4 and the hour indicating drum 7 pivotally supporting the hour indicating leaves 6 are passed on the main shaft 10 and are fitted between both side walls of the body frame 1. Further, the other component parts are assembled. Then, the synchronizing piece 11 is inserted from above between the minute indicating drum 5 and hour indicating drum 7 to engage the cut portion 11*c* with the main shaft 10. The end portion 11*d* is inserted into the through hole 1*a* and is twisted at the end by about 90 degrees to complete the assembling. As evident from this explanation, by the engagement of the end portion 11*d* with the through hole 1*a*, the rotation of the synchronizing piece 11 with the main shaft as a center is prevented. Further, by twisting the end portion 11*d*, the synchronizing piece 11 is prevented from separation off the body frame 1 and is fitted so that the main shaft 10 and cut portion 11*c* may not be disengaged from each other.

Figure 4:
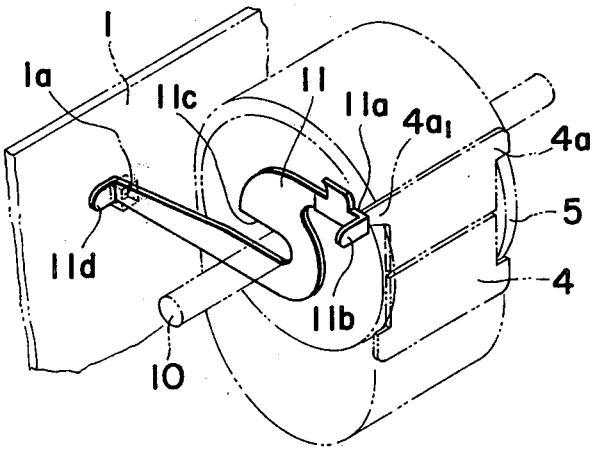

FIG. 4 shows another embodiment of the present invention somewhat different from the above explained embodiment. According to this embodiment, the end portion 11*d* of the synchronizing piece 11 is inserted in the through hole 1*a* made in the rear wall of the body frame 1 and is then bent substantially at right angles to connect the synchronizing piece 11 with the body frame 1. The assembly and operation of this device are the same as of the already explained embodiment. Therefore, the same respective numerals are only attached to the substantially same component parts and portions as are shown in FIG. 3. Any detailed explanation shall be omitted.

Figure 5:
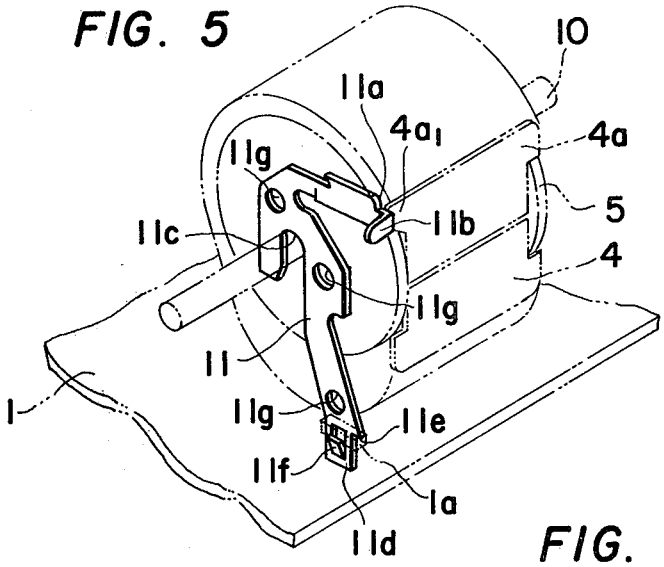

FIG. 5 shows still another embodiment of the present invention which is fundamentally the same as the embodiment in FIG. 3 but is somewhat different in the structure of connecting the synchronizing piece 11 with the body frame 1 from the embodiments shown in FIGS. 3 and 4. That is to say, according to this embodiment, a stepped portion 11*e* to be engaged with the front surface of the bottom wall of the body frame 1 when the end portion 11*d* is inserted in the through hole 1*a* and a tongue portion 11*f* to be engaged at the free end edge with the back surface of the bottom wall of the body frame 1 are formed in the end portion 11*d* of the synchronizing piece 11 so that, by holding the bottom wall of the body frame 1 between the stepped portion 11*e* and tongue portion 11*f*, the synchronizing piece 11 may be connected with the body frame 1 (See FIG. 6.). As the tongue portion 11*f* is so formed as to expand upward at the free end, in case the end portion 11*d* is inserted into the through hole 1*a*, the tongue portion 11*f* will be once contracted by the peripheral edge of the through hole 1*a* but, the moment the tongue portion 11*f* passes out of the through hole 1*a*, it will again expand due to its habit. Therefore, according to this connecting method, there are advantages that not only the synchronizing piece 11 can be incorporated into the device more simply and easily but also the position of the synchronizing piece 11 can be held very accurately and the bad influence of the cut portion 11*c* on the rotating motion of the main shaft 10 can be properly eliminated. Further, according to this embodiment, a plurality of holes 11*g* are made in the synchronizing piece 11 so that the spring action of the synchronizing piece 11 may be made very softly. By the way, in this embodiment, too, the same respective numerals are attached to the same component parts and portions as in the already explained embodiments, the operation of the synchronizing piece is the same and therefore any further explanation shall be omitted.

Figure 6:
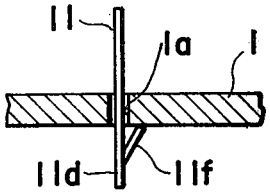
FIG. 6 is an enlarged partial sectional view showing the connection of the end portion of the synchronizing piece shown in FIGS. 5 and 7 with a body frame.
Figure 7:
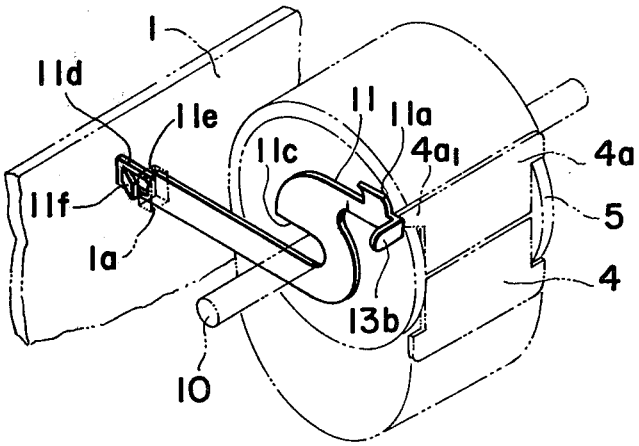

FIG. 7 shows an embodiment in the case that the same structure as is explained with reference to FIGS. 5 and 6 is adopted for the method of connecting the synchronizing piece 11 with the body frame 1. According to this embodiment, there are the same advantages as are explained with reference to FIGS. 5 and 6 but the operation of the synchronizing piece is the same as in the case of the other already described embodiments. Therefore, the same respective numerals are only attached to the same component parts and portions. Any detailed explanation shall be omitted.

It is needless to say that the present invention is not limited to the avove described various embodiments, can be variously modified and changed within the range of the appended claims, is not limited to the time indicating device and can be applied to any other indicating devices wherein it is necessary to turn a plurality of leaf indicating means as synchronized.

What is claimed is:

1. A leaf type indicating device comprising a body frame, a main shaft supported by said body frame, at least a pair of indicating drums mounted for rotation at different speeds on said main shaft adjacent to each other and each pivotally supporting a plurality of leaves having indicating indicia thereon, and a synchronizing piece mounted on said main shaft so as to be able to be taken out in a direction intersecting at right angles with said main shaft between said pair of indicating drums and having thereon a side portioon engageable with a lug formed on one of said plurality of leaves pivotally supported on one indicating drum rotating at a comparatively high speed relative to the other of said indicating drum and having thereon a bent portion engageable with said plurality of leaves pivotally supported on the other indicating drum rotating at a comparatively low speed and having thereon an end portion separably connected with said body frame, whereby, in order to successively turn said plurality of leaves, said bent portion is engaged with one of said plurality of leaves to be successively turned by the rotation of said other indicating drum to prevent said leaf from turning when said lug engages with said side portion during the rotation of said one indicating drum and said bent portion disengages from one of said plurality of leaves and one of the plurality of leaves pivotally supported on each of said pair of indicating drums turns simultaneously with each other when said lug disengages from said side portion.

2. A leaf type indicating device according to claim 1 wherein the connection of said end portion with said body frame is effected by a through hole made in said body frame and a portion twisted after being inserted into said through hole.

3. A leaf type indicating device according to claim 1 wherein the connection of said end portion with said body frame is effected by a through hole made in said body frame and a portion bent after being inserted into said through hole.

4. A leaf type indicating device according to claim 1 wherein the connection of said end portion with said body frame is effected by a through hole made in said body frame, a stepped portion formed on said end portion and engaging with one side surface of said body frame when said end portion is inserted into said through hole and a tongue portion formed on said end portion and having an end edge engaging with the other side surface of said body frame when said end portion has been inserted into said through hole.

5. A method of assembling leaf type indicating devices comprising a step of mounting on a main shaft a pair of indicating drums each pivotally supporting a plurality of leaves, a step of inserting a synchronizing piece between said pair of indicating drums to mount it on said main shaft from a direction intersecting at right angles with said main shaft, a further step of inserting an end portion of said synchronizing piece into a through hole made in a body frame supporting said main shaft, and a step of connecting said end portion with said body frame after inserting said end portion into said through hole.

* * * * *